United States Patent [19]

Goldman

[11] 4,102,468

[45] Jul. 25, 1978

[54] STACKABLE PAINT TRAY

[76] Inventor: Robert Ivan Goldman, 6658 Cibola Rd., San Diego, Calif. 92120

[21] Appl. No.: 751,026

[22] Filed: Dec. 16, 1976

[51] Int. Cl.[2] ..... B65D 25/24; B05C 11/46; A45C 5/14; B65D 21/02

[52] U.S. Cl. ..... 220/69; 15/257.06; 206/515; 206/518; 220/1 R; 248/151

[58] Field of Search ..... 220/69, 1 R; 206/515, 206/518; 15/257.06; 248/150, 151, 165, 456

[56] References Cited

U.S. PATENT DOCUMENTS

| | | | |
|---|---|---|---|
| 3,139,188 | 6/1964 | Goetz | 220/1 R |
| 3,333,282 | 8/1967 | Mustee | 248/165 |
| 3,608,600 | 9/1971 | Lehrman | 248/150 |
| 3,615,039 | 10/1971 | Ward | 206/518 |
| 3,850,298 | 11/1974 | Jolly | 220/69 |
| 3,903,641 | 9/1975 | Hoffman | 220/69 |

FOREIGN PATENT DOCUMENTS

| | | | |
|---|---|---|---|
| 802,713 | 12/1968 | Canada | 220/69 |
| 1,177,569 | 9/1964 | Fed. Rep. of Germany | 220/69 |

*Primary Examiner*—George E. Lowrance
*Attorney, Agent, or Firm*—Brown & Martin

[57] ABSTRACT

A paint tray of a generally rectangular configuration having a flat bottom portion and an upwardly sloping bottom portion with surrounding upwardly extending side walls for containing paint is molded of a high density polyethylene plastic material and constructed with removable legs, the legs being molded of a generally L-shaped configuration having a pin member on one end thereof for engagement with a socket formed in the bottom of the tray for tight fitting interfering engagement therewith. The removable legs provides a design for easy molding and provides a construction which is stackable with the legs removed for ease in shipping.

6 Claims, 5 Drawing Figures

STACKABLE PAINT TRAY

BACKGROUND OF THE INVENTION

The present invention relates generally to paint containers and pertains particularly to an improved paint tray and method of making same.

The application of paint to walls and similar surfaces by means of rollers is well known in the art. Such rollers are normally used in conjunction with a paint tray having a generally rectangular configuration with a deep forward portion for containing the paint and a sloping shallow rearward portion for evenly distributing the paint on the roller and letting excess paint to run back to the deep portion of the tray. Such trays normally have a pair of legs supporting the shallow rearward portion. Such prior art trays are normally constructed of sheet metal because of the configuration of the legs which makes removal of such trays from plastic molding machines difficult.

Another problem with such prior art trays is the space taken up by the legs of the tray which are normally intregal therewith. The space taken up by the trays make shipping thereof extremely expensive.

Accordingly it is desirable that a tray be available which is easy and simple to make by molding in a plastic material and at the same time is less space consuming than prior know constructions.

SUMMARY AND OBJECTS OF THE INVENTION

Accordingly it is the primary object of the present invention to overcome the above problems of the prior art.

Another object of the present invention is to provide a paint tray that is simple and easy to manufacture from plastic materials by a molding process.

A further object of the present invention is to provide a paint tray which is less space consuming than prior known devices.

A still further object of the present invention is to provide a molded plastic paint tray and method of making same having removable legs for simplifying construction facilitating shipping.

In accordance with the primary aspect of the present invention a paint tray of a generally rectangular configuration is constructed of a high density plastic material having removable legs which are easily and quickly mounted into sockets fit into the underside of the tray.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
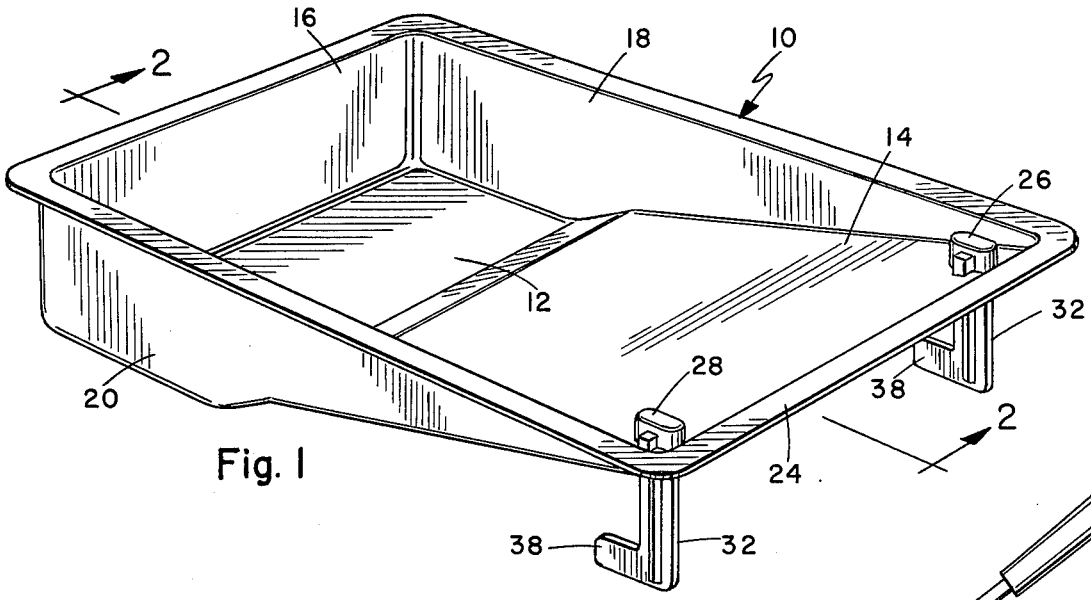
FIG. 1 is a perspective view of a paint tray in accordance with the invention.
Figure 2:
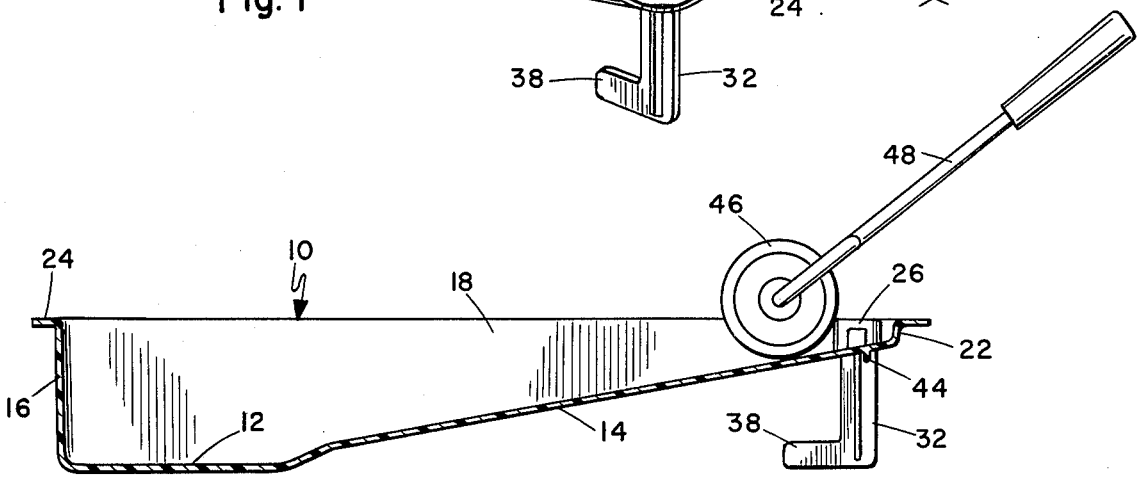
FIG. 2 is a sectional view taken of line 2—2 of FIG. 1.

Turning now to the drawing and particularly to FIGS. 1 and 2 there is illustrated a paint tray generally designated by the numeral 10 in accordance with the present invention. The tray is constructed to have a deep end which may be designated the forward end and defined by a generally flat rectangular bottom 12 which merges into a sloping floor portion 14 sloping upward from the deep end to define a shallow end of the tray generally termed the rear end of the tray. The tray includes walls extending upward from the bottom to define a container. These walls comprise a forward wall 16, a pair of side walls 18, and 20, and a rear or back end wall 22. A horizontal outwardly extending flange 24 extends continuously around the upper edge of the side walls to enhance the structural rigidity thereof. The tray is designed to have a generally rectangular configuration from the top view, as shown, having a deep portion at the forward end thereof containing paint and a shallow end having a sloping floor 14 for use in distributing the paint evenly on the roll of a roller. This is generally done by dipping the roller in the paint at the deep end of the tray and rolling it back and forth along the sloped portion 14 such that the paint becomes evenly distributed on the roller and excess paint is pressed out of the roller and flows back into the deep end of the tray.

Figure 4:
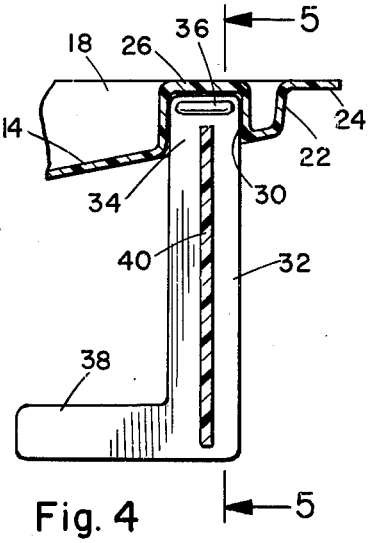
FIG. 4 is an enlarged sectional view taken on line 4—4 of FIG. 3.
Figure 5:
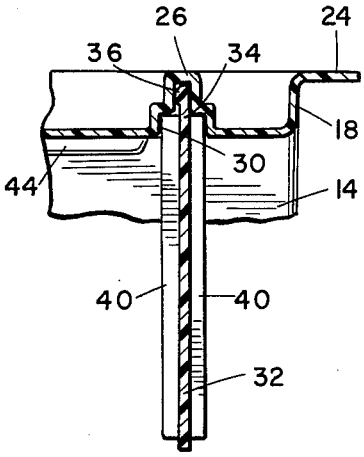
FIG. 5 is a sectional view taken on line 5—5 of FIG. 4.

The tray is designed and constructed with a pair of upwardly extending projections 26, and 28 extending upward inside the shallow end of the tray. These projections are shaped as seen in FIGS. 4 and 5 to define a socket 30 (only one shown) and also to define stop means to be described. These sockets are designed for mounting a pair of legs 32. Both legs are constructed to be identical for simplicity and ease of manufacture. Each leg includes an upper pin or plug portion 34 for tight fitting engagement into the socket 30 for mounting and retaining the leg in place. The plug portion 34 includes a detent member 36 in the form of a cross ridge extending transversely of the axis of the pin or plug. This ridge extends preferably to a width slightly greater than the width of the socket 30. Thus the plug and detent member must be forced into the socket and is tightly held into place by interference fit with the walls of the socket 30.

This interference fit is designed such that the tray being of a plastic material can be heated to a temperature to become somewhat pliable for ease of insertion of the plug into the socket. This can be done simply by dipping the shallow end of the tray into warm or hot water for a short period of time to permit the socket portion to become pliable. Upon insertion of the legs into the socket the tray is permitted to cool to room or ambient temperature such that the sockets shrink back to the normal size and retains the legs into place. Preferably the fit of the pin and socket is designed such that a temperature of between 25° and 30° C. would be sufficient to obtain sufficient pliability to permit insertion of the legs into place.

The legs 32 are of a generally L-shaped configuration as seen in FIGS. 1, 2, and 4, for example, having a lower arm or foot portion 38 extending forward toward the deep end of the tray. This arm or foot portion defines a foot for supporting the tray and a hook for hooking under the step of a ladder or other similar support. Because these legs 32 are removed from the tray when shipping a wide latitude in the size and shape of the legs may be permitted. This is also possible because of the independent molding of the legs separate from the tray itself. Thus, the legs shape or size and configuration need not be taken into consideration when holding the body portion of the tray which is done independently of the legs, and in shipping the body portion of the tray because the legs are not in position at that time. This removal of the legs for shipping purposes permits the trays to be stacked and thereby take up less space for shipping purposes. This considerably reduces the cost of shipping and the cost of storage.

Figure 3:
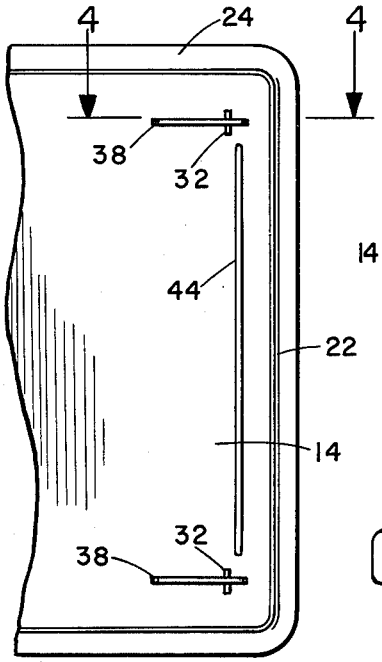
FIG. 3 is a bottom plan view of the shallow end of the tray.

The legs as best seen in FIG. 3 have a generally cruciform shape in cross section with side reinforcing ribs 40 on the sides thereof. The ribs extend into the sockets 30. This adds structural rigidity to the leg and enhances its ability to support the loaded paint tray so that the enhanced strength of the leg transfers to the tray.

The tray is provided with a reinforcing bar or ridge 44 molded into the under side thereof and extending between the two sockets 30 and leg supports. This enhances the structural rigidity of the tray itself.

The upper projections 26 and 28 as best seen in FIG. 2 define a stop means for a paint roller. As illustrated in FIG. 2, a paint roller 46 mounted on a handle or frame 48 is rolled back and forth on the surface 14. The roller engages the stop members 26 and 28, as seen, and stops the roller short of the shallow end wall 22. This prevents spilling of paint over the shallow end or edge of the tray. In carrying out the method of the invention, the tray is constructed or fabricated by selecting a high density plastic material such as a high density polyethylene, molding the body from the high density material, including forming the body with a generally rectangular configuration as illustrated having a deep end and a shallow end defined by a upwardly sloping floor portion. The forming of the body portion includes forming the body to have a pair of leg mounting sockets at the under side of the shallow end thereof and forming a pair of legs having plug portions for extending into tight fitting engagement with the sockets. Further steps include forming detent ridge means on the plug portions of the leg for tight fitting engagement with the sockets for retaining the legs in place in the sockets. The method includes the further step of forming upward projections in the shallow end of the tray with the sockets formed in the upwardly extending portions.

While the present invention is described and illustrated by means of a single embodiment it is to be understood that numerous changes and modifications may be made therein without departing from the spirit and scope of the invention as defined in the appended claims.

Having described my invention, I now claim:

1. A paint tray for use in conjunction with a paint roller, said tray defined by a generally rectangular bottom having a first generally flat portion at the front thereof and a sloping portion sloping upward from the front to the back of the tray, with side walls extending upward from the bottom thereby defining a container having a deep front end and a shallow rear end, the improvement comprising:

a pair of spaced apart vertically oriented sockets in the rear underside of said tray formed in projections extending upward from said sloping bottom in said tray, said projections define roller stop means for engaging and stopping a roller short of the back wall thereof; and a pair of independent detachable legs each having a plug for extending in tight fitting engagement into said sockets for detachably mounting said legs on said tray at the back underside thereof for supporting said tray and for removal therefrom for providing close stacking of a plurality of said trays.

2. The tray of claim 1 wherein said legs are L-shaped for hooking on the steps of a ladder, and; said plug includes a detent ridge for wedging engagement into the walls of said socket.

3. The tray of claim 2 wherein said tray includes a reinforcing ridge extending along the bottom thereof between said sockets.

4. The tray of claim 1 wherein the body of said legs have a generally cruciform shape in cross-section.

5. The tray of claim 4 wherein the cruciform shape extends into the sockets in the tray.

6. The tray of claim 4 wherein said tray is moulded of a high density polyethylene.

* * * * *